United States Patent [19]

Kato

[11] 4,278,878

[45] Jul. 14, 1981

[54] PASSING PERSON COUNTING APPARATUS

[75] Inventor: Toshio Kato, Seto, Japan

[73] Assignee: Tanaka Business Machines Co. Ltd., Aichi, Japan

[21] Appl. No.: 41,187

[22] Filed: May 21, 1979

[30] Foreign Application Priority Data

Apr. 11, 1978 [JP] Japan ..... 53-136040

[51] Int. Cl.[3] ..... G06M 3/14; G07C 9/00

[52] U.S. Cl. ..... 235/92 PK; 235/92 V; 235/92 EV

[58] Field of Search ..... 235/92 EV, 92 V, 92 PB, 235/92 PK; 250/221, 224

[56] References Cited

U.S. PATENT DOCUMENTS

| | | | |
|---|---|---|---|
| 3,808,410 | 4/1974 | Schlesinger | 235/92 PK |
| 4,000,400 | 12/1976 | Elder | 235/92 PK |
| 4,009,389 | 2/1977 | Lindholm | 235/92 PK |
| 4,070,560 | 1/1978 | Blanyer | 235/92 EV |
| 4,081,661 | 3/1978 | Durbin | 235/92 PK |

FOREIGN PATENT DOCUMENTS

| | | |
|---|---|---|
| 1902243 | 9/1969 | Fed. Rep. of Germany . |
| 1252253 | 3/1971 | United Kingdom . |
| 1251371 | 10/1971 | United Kingdom . |

*Primary Examiner*—Joseph M. Thesz
*Attorney, Agent, or Firm*—Browdy and Neimark

[57] ABSTRACT

A passing person counting apparatus, installed at a path (passageway) having a width allowing one person to pass through, for counting the number of persons who pass there in a various different mode or posture, automatically and exactly. It is provided with a trunk portion sensing section with at least a pair of photo-switches, installed at a height of the trunk portion of a human body with an inter-distance slightly narrower than the thickness of the trunk portion, and a leg portion sensing section with at least a pair of photo-switches, installed beneath the former and very closely to each other. The apparatus is constructed such that it counts up one person when at least the under-mentioned three conditions have been fulfilled: (1) all of the photo-switches of the trunk portion sensing section are simultaneously interrupted at least once; (2) the photo-switches of the leg portion sensing section are interrupted while at least one of the photo-switches of the trunk portion sensing section is being interrupted; and (3) the leg which has interrupted the photo-switches of the leg portion sensing section advances in the passing direction without making a turning back.

10 Claims, 17 Drawing Figures

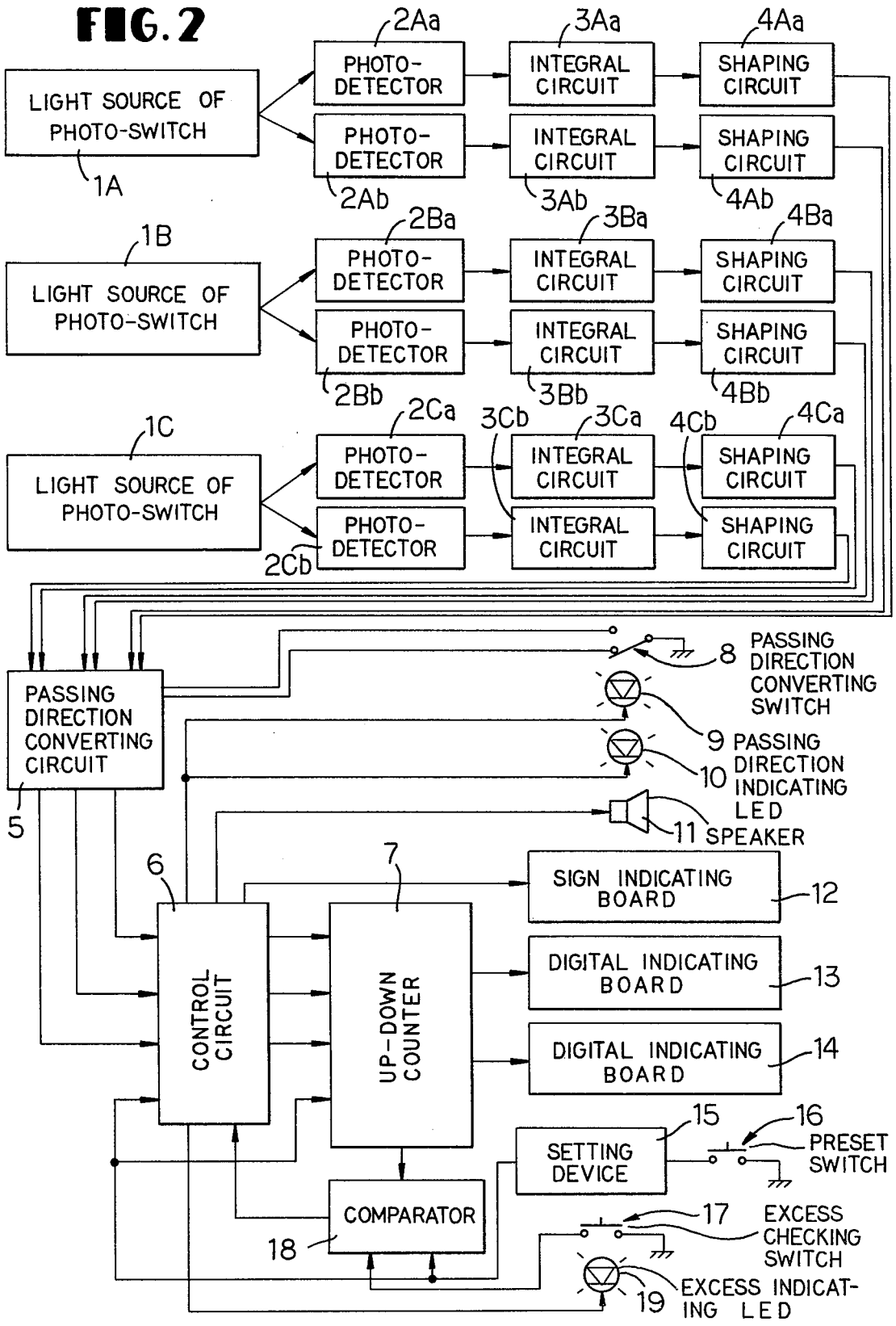
FIG. 2
LIGHT SOURCE OF PHOTO-SWITCH
1A
1B
1C
PHOTO-DETECTOR
2Aa
2Ab
2Ba
2Bb
2Ca
2Cb
INTEGRAL CIRCUIT
3Aa
3Ab
3Ba
3Bb
3Ca
3Cb
SHAPING CIRCUIT
4Aa
4Ab
4Ba
4Bb
4Ca
4Cb
PASSING DIRECTION CONVERTING CIRCUIT
5
8
PASSING DIRECTION CONVERTING SWITCH
9
10
PASSING DIRECTION INDICATING LED
11
SPEAKER
6
CONTROL CIRCUIT
7
UP-DOWN COUNTER
SIGN INDICATING BOARD
12
DIGITAL INDICATING BOARD
13
DIGITAL INDICATING BOARD
14
SETTING DEVICE
15
16
PRESET SWITCH
COMPARATOR
18
17
EXCESS CHECKING SWITCH
19
EXCESS INDICATING LED

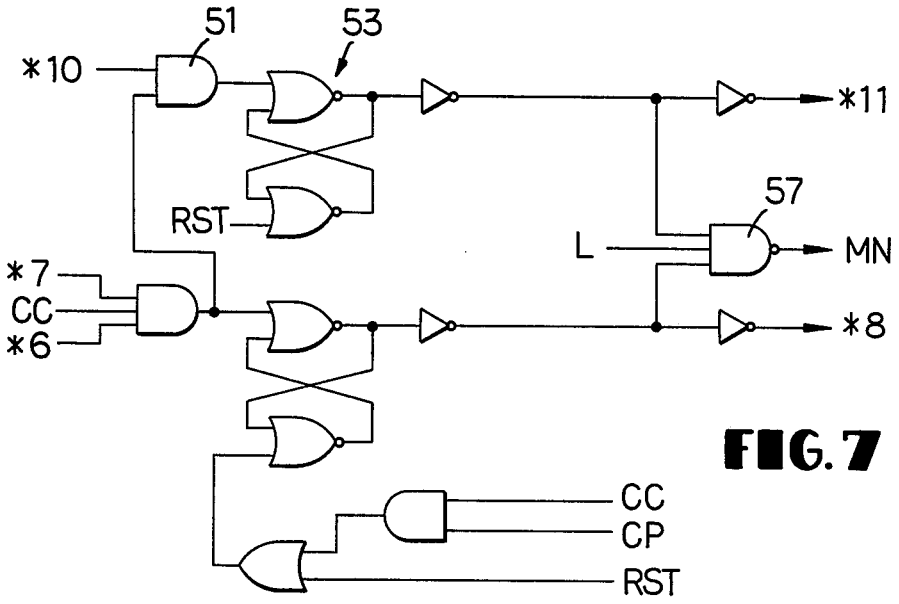
FIG. 7
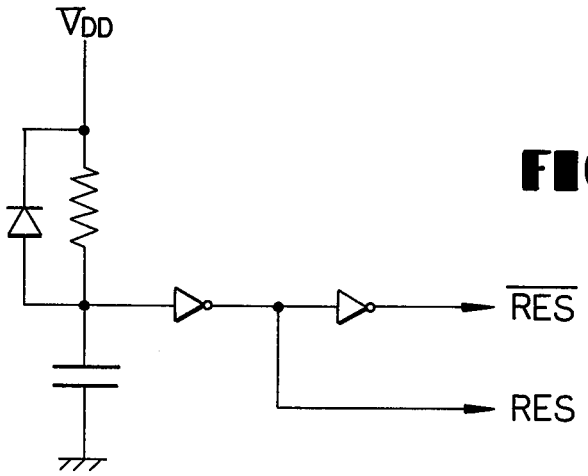
FIG. 8
FIG. 9
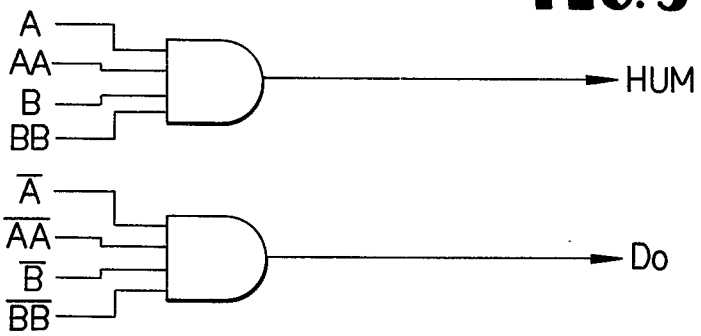

PASSING PERSON COUNTING APPARATUS

BACKGROUND OF THE INVENTION

This invention relates to a passing person counting apparatus installed at places where counting of the number of persons or passengers coming and going passing therethrough is constantly required, such as entrances or steps of transportation means, for example, automobiles, ships, trains, or airplanes, of public houses, for example, banks, department stores, shops, museums, theaters, office buildings, or of public facilities, for example, zoos, juvenile parks, recreation grounds, etc.

Taking up a case of a sight-seeing bus, it was a traditional common way of counting or ascertaining the number of passengers or group members thereon to count it by means of visual direct counting one by one, roll calling. And in particular, when some of or all of the members get out of the vehicle on the way for sight-seeing or taking a rest, a person who is responsible for counting the number of the members, such as a driver, a conductor, a guide had to repeat a trouble of confirming the number, often by means of requesting the members themselves to ascertain the getting on board or coming back to the seat of the neighboring member. Such a way of counting or ascertaining the number was not only irrational but also inaccurate to cause sometimes a shortage of embarkation of the members. This tendency is also true with cases of trains, ships, or airplanes.

SUMMARY OF THE PRESENT INVENTION

This invention was made from such a background. It is therefore a primary object of this invention to provide a passing person counting apparatus capable of counting automatically and accurately the number of people who pass a specific place in various posture or mode.

It is another object of this invention to provide a passing person counting apparatus capable of achieving the above-mentioned object, which is further as simple as possible in its structure and as low as possible in its manufacturing cost.

BRIEF DESCRIPTION OF THE DRAWINGS

FIG. 2 is a block chart showing the whole structure of the passing person counting apparatus including electric circuits and component parts;

FIGS. 4 through 9 are respectively a detailed diagram of a circuit in a control circuit 6, in which;

FIG. 4 is a circuit for generating signals RST and FT;

FIG. 5 is a circuit for generating signals R, L;

FIG. 6 is a circuit for generating signal PL from signal R;

FIG. 7 is a circuit for generating signal MN from signal L;

FIG. 8 is a circuit for generating signal RES;

FIG. 9 is a circuit for generating signal HUM;

DETAILED DESCRIPTION OF A PREFERRED EMBODIMENT

With reference to appended drawings a preferred embodiment will be described hereunder.

In this embodiment, as a sensor a photo electric switch (hereinafter simply called photo-switch) is employed. An example in which four combinations or pairs of them composed of two groups are disposed in a trunk portion sensing section, and two pairs, forming one group, are disposed in a leg portion sensing section will be described.

Figure 1:
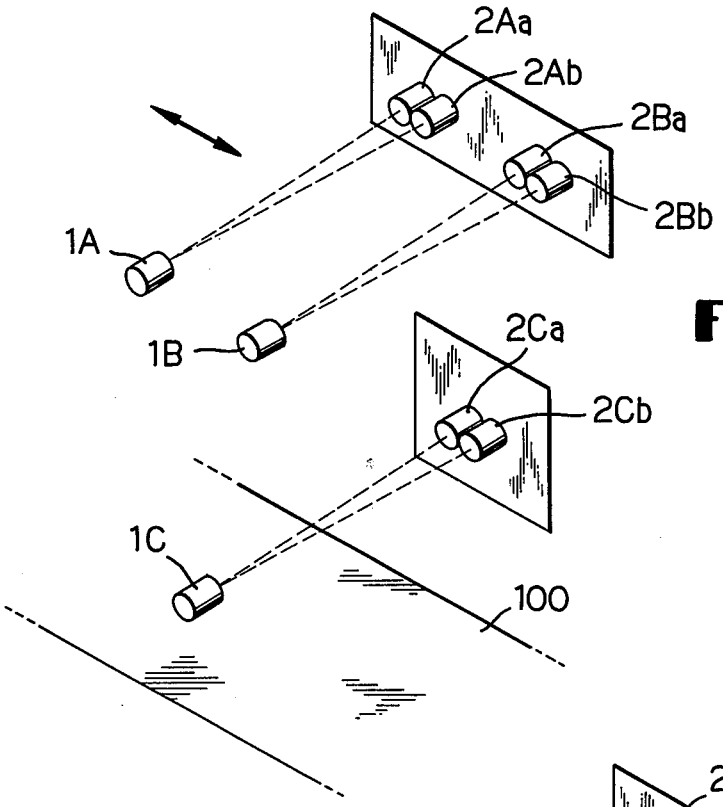
FIG. 1 is a perspective view showing the arrangement of a set of photo electric switches in a passing person counting apparatus of this invention.

As can be seen in FIG. 1, in a passageway 100 having a certain width allowing one man's passing, the trunk portion sensing section for detecting the passing of the trunk portion of a human body is installed, as two groups of photo-switches, at right angle to the direction of the arrow showing the coming and going of the people with a certain horizontal distance therebetween; and the leg portion sensing section for detecting the passing of the leg portion of a human body is installed beneath the trunk portion sensing section as one group of photo-switches. Those photo-switches are all consisted of a light source (signal sending side) and a photodetector (signal receiving side) and operated by any of visible rays, infrared rays, ultraviolet rays, etc. In the trunk portion sensing section, a first photo-switch group is composed of a first light source 1A and a first pair of photodetectors 2A*a*. 2A*b* and a second photo-switch group is composed of a second light source 1B and a second pair of photodetectors 2B*a*, 2B*b*; and in the leg portion sensing section, one group of photo-switches is composed of a light source 1C and a pair of photodetectors 2C*a*, 2C*b*.

When mode of passing of the people is ordinary, one group of photo-switches in the trunk portion sensing section and one group of photo-switches in the leg portion sensing section are thought enough for the purpose of counting the number of passers. However, complicated mode of passing, such as a man carrying a baggage or a man walking with largely swinging arms will sometimes mis-operate the afore-mentioned device. It is desirable to additionally install another photo-switch group to the trunk portion sensing section, as in this embodiment, that is to say, one group as the leg portion sensing section and two groups as the trunk portion sensing section for perfectly detecting the number of the passing people. Arrangement of photo-switches of this embodiment will be summarized hereunder.

(1) Two pairs of photodetectors 2A*a*, 2A*b*, and 2B*a*, 2B*b* of the trunk portion sensing section are fixed on a wall or some other suitable place by such as sticking, with a small inter-distance, for example 0.3–3.0 cm, for forming two groups of photo-switches with a respective single light source 1A, 1B positioned in confrontation having the passageway therebetween. The two groups are arranged substantially horizontally with a lateral inter-distance of approximately 20 cm therebetween, at a height of approximately 80 cm. The arrangement of the two groups are required to satisfy a condition that the ray of light emanated from the light source 1A, 1B can directly reach each of the corresponding two photodetectors 2A*a*, 2A*b*, and 2B*a*, 2B*b*, crossing the passageway substantially horizontally.

(2) The photo-switches of the leg portion sensing section are installed, between the two groups of the trunk portion sensing section and the floor surface (passage surface), right beneath the middle portion of the two groups of photo-switches of the trunk portion sensing section, at a height of approximately 20 cm from the floor surface.

The above-mentioned dimensions of arrangement are concerned to an ordinary average case. As to specific cases, for example, an escort bus for kindergarten children, a facility exclusively purposed for children, etc., wherein the sphere of the passer's stature is confined within a certain limit, the position of arrangement of the photo-switches, regarding both the trunk portion sensing section and the leg portion sensing section, must be adjusted and adapted to the desired object. In short, the groups of the photo-switches for the trunk portion sensing are required to be installed at a height in the range common to all objective human trunk portions with an inter-distance slightly smaller than the thickness of the smallest one of the objective human trunk portions, and the photo-switch group for the leg portion sensing should be installed at a lower part of the human leg portion (not too low as feared to be passed by stepped over or strided over the rays of light).

In case of getting on or out of board an airplane or a steamer, a plane ramp or a gangway is normally used. If those passageways are of style to pass two rows of people walking in line, the passageway should be adjusted to be a pair of pathes by means of a pole or some other suitable dividing means, capable of having respectively the invented apparatus attached thereto. The situation is similar as to the entrance to buildings or other facilities.

Figure 16:
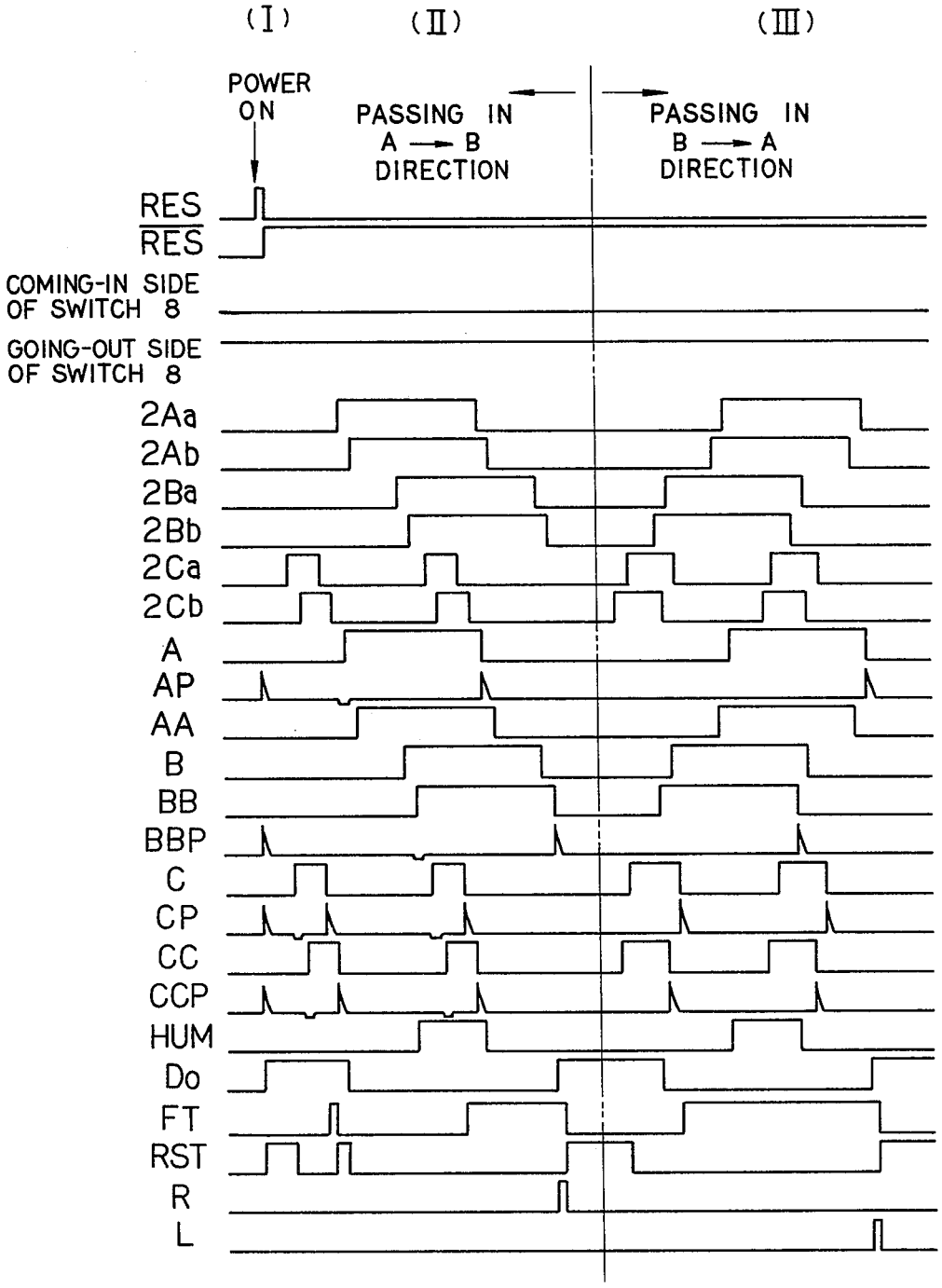
FIG. 16 is a timing chart from the power source ON to the generation of R, L signals, when a coming-in direction converting switch is connected to the coming-in side.

According to the drawings illustrated, the connection or structure of electric circuits will be explained hereunder. In the block chart of FIG. 2, 1A, 1B, and 1C designate respectively a light source of a photo-switch; and 2A*a*, 2A*b*, 2B*a*, 2B*b*, 2C*a*, and 2C*b* designate respectively a photodetector of a photo-switch. Each of those groups, composed of one light source and two corresponding photodetectors has a function of judging the direction of a person passing across the rays of the photo-switches. 3A*a*, 3A*b*, 3B*a*, 3B*b*, 3C*a*, and 3C*b* designate respectively an integral circuit for eliminating noise components, and 4A*a*, 4A*b*, 4B*a*, 4B*b*, 4C*a*, and 4C*b* indicate respectively a wave shaping circuit for shaping the integrated wave form. Numeral 5 indicates a passing direction converting circuit for determining, when a person passes in the A→B direction, whether to count it as plus one or minus one by means of changing over a passing direction converting switch 8. Each of the integral circuit 3A*a*–3C*b*, the wave shaping circuit 4A*a*–4C*b* and the passing direction converting circuit 5 shown in FIG. 2 will be further illustrated in detail in FIG. 3. The photodetectors 2A*a*, 2A*b*, 2B*a*, 2B*b*, 2C*a*, and 2C*b* are respectively to produce a signal "H" (high level), which will be integrated by an integral circuit composed of a resistor and a capacitor and then wave-shaped by an inverter. If the passing direction converting circuit 8 is, in this instance, connected to the coming-in (passing-in) side, the output signals of AND gates 5A*a*-1, 5A*b*-1, 5B*a*-1, 5B*b*-1, 5C*a*-1, and 5C*b*-1, which are hatched in FIG. 3, can assume selectively two levels, "H" or "L" (low level), according to the input signal. On the other hand, the output signals of unhatched AND gates, 5B*b*-2, 5B*a*-2, 5A*b*-2, 5A*a*-2, 5C*b*-2, and 5C*a*-2 assumes constantly "L" irrespectively of whether the input signal be "H" or "L", with the gate being closed. When a person passes in the direction of interrupting the photo-switches (1A-2A*a*, 1A-2A*b*)→(1B-2B*a*, 1B-2B*b*), in this order, and at the same time crossing the photo-switches (1C-2C*a*, 1C-2C*b*), in this order, the signal "H" appears in the order of, as shown in the left half of FIG. 16, A→AA→B→BB, and C→CC. When a person goes out in the direction of crossing the photo-switches, (1B-2B*b*, 1B-2B*a*)→(1A-2A*b*, 1A-2A*a*), in this order, and at the same time to cross (1C-2C*b*, 1C-2C*a*), in this order, the signal "H" appears in the order of, as shown in the right half of FIG. 16, BB→B→AA→A, and CC→C. In case of the passing direction converting switch 8 being connected to the going-out side, the hatched AND gates are closed, and the output signals of the unhatched AND gates can assume two levels "H" or "L", according to the state of the input signal. When a person comes in, in the manner of crossing the photo-switches in the order of (1A-2A*a*, 1A-2A*b*)→(1B-2B*a*, 1B-2B*b*) and at the same time in the order of (1C-2C*a*, 1C-2C*b*), the "H" signal appears in the order of BB→B→AA→A and CC→C. When a person goes out, in the manner of crossing the photo-switches in the order of (1B-2B*a*, 1B-2B*a*)→(1A-2A*b*, 1A-2A*a*) and at the same time in the order of (1C-2C*b*, 1C-2C*a*), the "H" signal appears in the order of A→AA→B→BB and C→CC.

Figure 3:
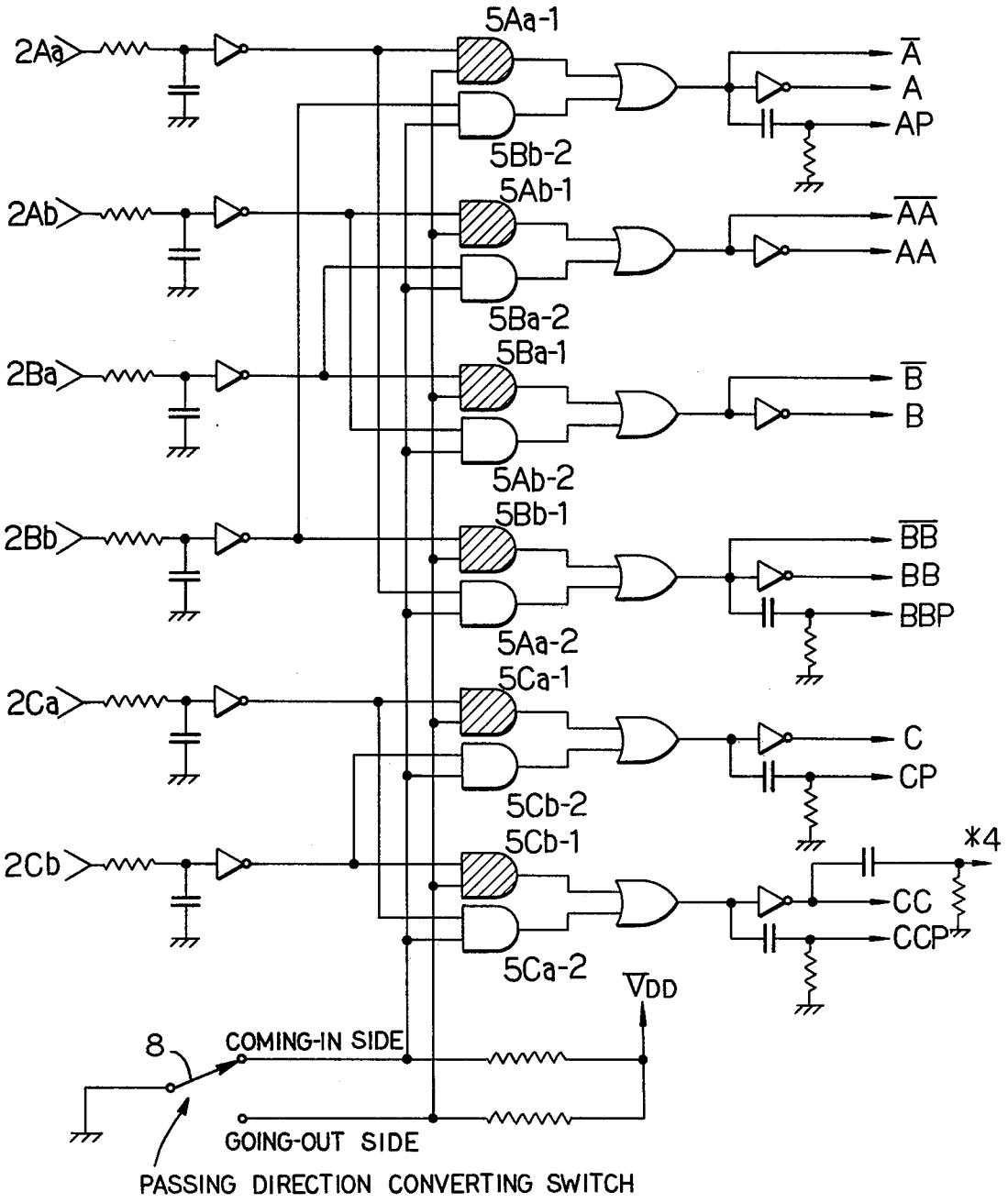
FIG. 3 is a block chart of circuits showing a part of FIG. 2 from a photodetector to a circuit of switching the coming-in direction.

The control circuit 6 in FIG. 2 will be developed in greater detail in FIG. 4 through FIG. 9, in which FIG. 8 designates a circuit for producing, when the power source is turned to ON, signals $\overline{RES}$ and RES. Both of $\overline{RES}$ and RES are signals for resetting flip-flop circuits and counters. The upper half of FIG. 9 indicates the production of a signal HUM from the four signals of A, AA, B, and BB, which are indicated in FIG. 3. This signal HUM is to be "H" level while all of the photo-switches 1A-2A*a*, 1A-2A*b*, 1B-2B*a*, and 1B-2B*b* are interrupted. The lower half of FIG. 9 indicates the production of a signal $D_o$ from the four signals $\overline{A}$, $\overline{AA}$, $\overline{B}$ and $\overline{BB}$. This signal $D_o$ is to be "L", while any of the photo-switches 1A-2A*a*, 1A-2A*b*, 1B-1B*a*, and 1B-2B*b* is interrupted.

Figure 4:
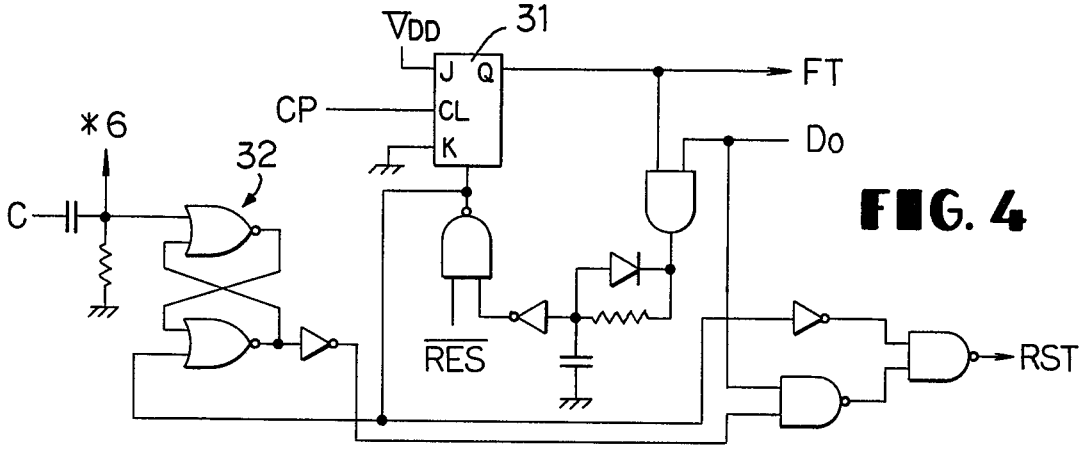

FIG. 4 indicates a circuit for producing signals FT, RST from the signals CP, C, $D_o$, and $\overline{RES}$. The signal $\overline{RES}$ keeps the "L" status for a certain period of time since the power source is turned to ON; it will remain in the state of "H" after having reset the J-K flip-flop 31 and the R-S flip-flop 32. The RST turns to "H" status by the resetting of the flip-flop 32. When a person passes the photo-switches of the leg portion sensing section (when the passing direction converting switch 8 is connected to the coming-in side, the photo-switch 1C-2C*a*, and when connected to the going-out side, the photo-switch 1C-2C*b*) the signal C becomes "H" and the signal RST "L". The moment when the passing has been over the signal C turns to "L" and the signal CP becomes "H" for just a moment; J-K flip-flop 31 is set and the signal FT turns to "H". If the signal $D_o$ is "H" ($D_o$="H") at this moment (a status wherein none of the 1A-2A*a*, 1A-2A*b*, 1B-2B*a*, and 1B-2B*b* is not interrupted) J-K flip-flop 31 and the R-S flip-flop 32 will be unconditionally, after a certain period of time, reset and the signal RST turns to "H" and the signal FT "L". When the photo-switches of the leg portion sensing section is interrupted, while $D_o$="L" is maintained, the signal FT will keep its "H" status until the $D_o$="H" status comes up. When the $D_o$="H" status has been produced the J-K flip-flop 31 will be reset after a certain period of time and the signal FT turns to "L". In other words, the circuit shown in FIG. 4 will not memorize, even when only the photo-switches of the leg portion sensing section are interrupted, the signal FT. Only when the interruption takes place at the leg portion sensing section while at least in one of the photo-switches of the trunk portion sensing section is interrupted, the signal FT is memorized, and the memory is maintained until when none of the photo-switches of the trunk portion sensing section be interrupted.

Figure 5:
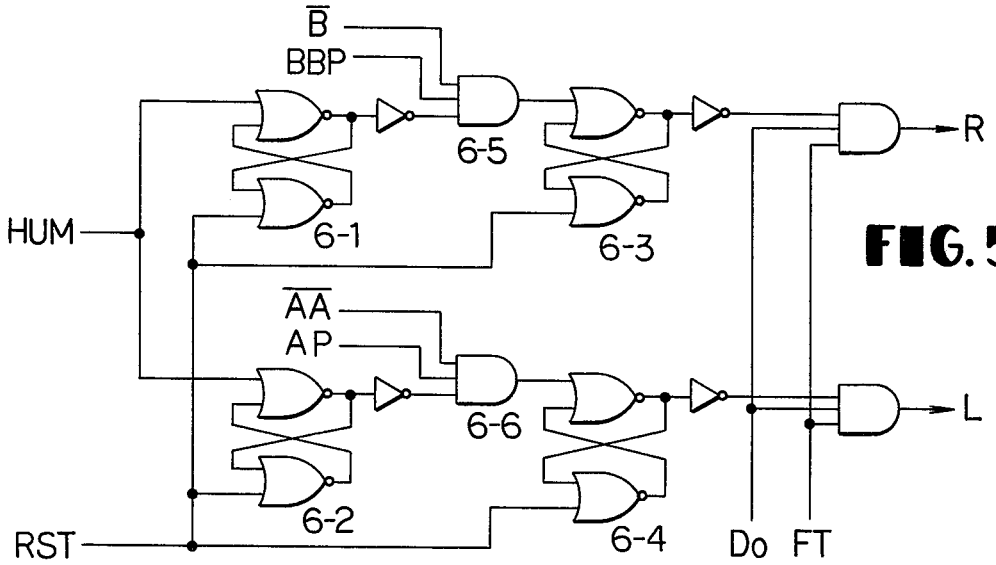

FIG. 5 indicates a circuit where the signal R, L are produced from the signals HUM, RST, $\overline{B}$, BBP, $\overline{AA}$, AP, $D_o$, and FT. When the signal RST becomes "H", the output of the R-S flip-flop circuit 6-1, 6-2, 6-3, and 6-4 will be set at "H", which "H" will be maintained even when the signal RST turns to "L". When the signal HUM becomes "H" (all of the photo-switches of the 1A-2A*a*, 1A-2A*b*, 1B-2B*a*, and 1B-2B*b* are interrupted) even for a moment, while the signal RST is "L", the output of the R-S flip-flop 6-1, 6-2 become "L" and the AND gates 6-5, 6-6 are opened. If the passing direction converting switch 8 is herewith connected to the coming-in side and a person interrupts the photo-switches in the order of (1B-2B*a*)→(1B-2B*b*), or if the passing direction converting switch 8 is connected to the going-out side and a person interrupts the photo-switches in the order of (1A-2A*b*)→(1A-2A*a*), the output of the R-S flip-flop 6-3 will become "L", and the output R will become "H" on condition that $D_o$ and FT, described in respect of FIG. 4, satisfy the conditions of $D_o$="H" and FT="H". On the other hand, if the passing direction converting switch 8 is connected to the coming-in side and a person interrupts the photo-switches in the order of (1A-2A*b*)→(1A-2A*a*) or if the passing direction converting switch 8 is connected to the going-out side and a person interrupts the photo-switches in the order of (1B-2B*a*)→(1B-2B*b*), the output of the R-S flip-flop 6-4 becomes "L" and the output L will turn to "H" when the conditions of $D_o$="H" and FT="H" are satisfied. The said conditions $D_o$="H" and FT="H" are maintained for a certain period of time as described in respect of FIG. 4.

Figure 6:
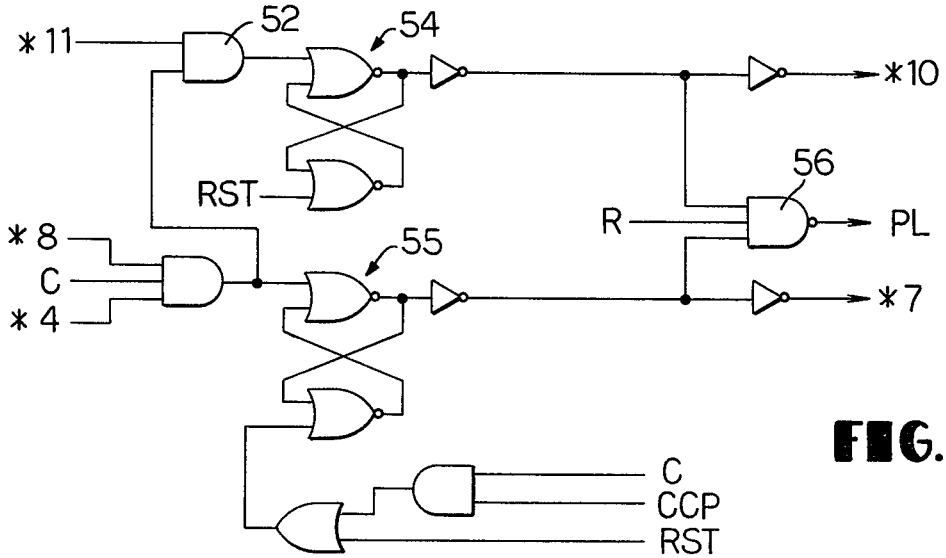

FIG. 6 and FIG. 7 indicate respectively a circuit for blocking the signals R and L mis-output from the circuit shown in FIG. 5, which may happen to be non-corresponding to the actual coming and going direction of the passers. For example, in a case wherein a person interrupts once the photo-switches in the order of (1C-2C*a*)→(1C-2C*b*) and turns back without passing through in the inverse direction to interrupt the photo-switches in the order of (1C-2C*b*)→(1C-2C*a*), a mis-counting of one person's passing in the order of (1C-2C*b*)→(1C-2C*a*) may take place. In order to prevent this mis-counting, when the passing in the order of (1C-2C*a*)→(1C-2C*b*) is once recognized the count gate 57 of the (1C-2C*b*)→(1C-2C*a*) is closed and that status can be maintained, owing to the structure of this apparatus, until the counting in the direction of (1C-2C*a*)→(1C-2C*b*) is over. In other words, according to which one of the two photo-switches of the leg portion sensing section (1C-2C*a*), (1C-2C*b*) be interrupted, either one of the circuits of FIGS. 6 and 7 will be selectively effectuated; and the output *10 or *11 on the effectuated side circuit will close the AND gate 51 or 52 on the other side. And the circuits of FIGS. 6 and 7 are mutually interlocked in order not to set the flip-flop R-S 53 or 54 on the other side. As a result, when the circuit of FIG. 5 produces a wrong signal L though the photo-switch (1C-2C*a*) has been interrupted in advance of the photo-switch (1C-2C*b*) or when the circuit of FIG. 5 produces a wrong signal R though the latter photo-switch has been interrupted in advance of the former photo-switch, the signal MN or PL is prevented from being erroneously produced. Besides, conditions necessary to effectuate the circuit of FIG. 6 are defined to the following two items: (1) the circuit of FIG. 7 is not being effectuated to maintain the signal *8 at "H", and (2) while the photo-switch (1C-1C*a*) is being interrupted to make the signal C "H", the photo-switch (1C-1C*b*) is interrupted to turn the signal *4 to "H", that is to say, the photo-switch (1C-1C*a*) must be interrupted earlier than the photo-switch (1C-1C*b*). When those two conditions are fulfilled the R-S flip-flops 54, 55 are set to effectuate the circuit of FIG. 6. A status, wherein the PL signal can be produced in correspondence to the signal R, is made. The circuit of FIG. 6 is, furthermore, constructed such that a once set R-S flip-flop 55 owing to the fulfillment of the above-mentioned conditions is rest, when a leg portion which interrupted the photo-switches of the leg portion sensing section turns back while the trunk portion of the same person has not passed through the trunk portion sensing section, that is to say, when a phenomenon of turning signal CCP to "H" while the signal C is being "H" arises, before the appearance of the signal RST from the circuit of FIG. 4. It makes possible to prevent a miscounting by means of closing the AND gate 56 when a person turns back halfway. The above description holds true also in respect of the circuit of FIG. 7, permitting omission of superfluous explanation, with an only note that the signal MN can be produced in the circuit of FIG. 7 in response to the signal L. Through the above-mentioned operation the signal PL can be produced from the signal R and the signal MN from the signal L.

Figure 10:
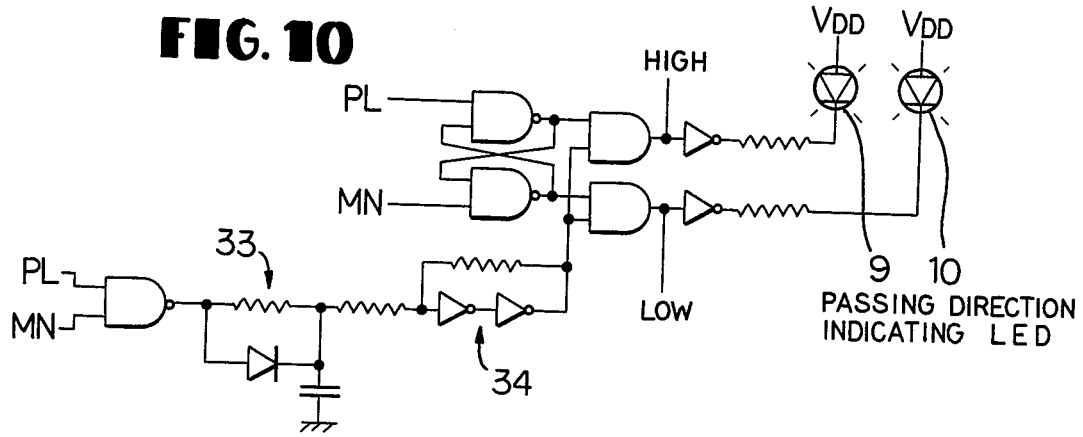
FIG. 10 is a circuit for lightening coming-in direction indicating lamps 10 and 11.

FIG. 10 indicates a circuit which produces signals HIGH or LOW from the signals PL or MN obtained respectively in the circuit of FIGS. 6 and 7, and also illuminates an LED for indicating the passing direction designated with 9 or 10 in FIG. 2. As the signals PL and MN are pulses produced under the condition of $D_o$="H", the period of "L" is short, being improper used for lightening the LED, so the pulse length is expanded (lengthened) via a CR time constant circuit 33 and a Schmidt trigger circuit 34 to generate the signal HIGH from the signal PL and the signal LOW from the signal MN for the purpose of making the luminescence of the LED easy to be noticed.

Figure 11:
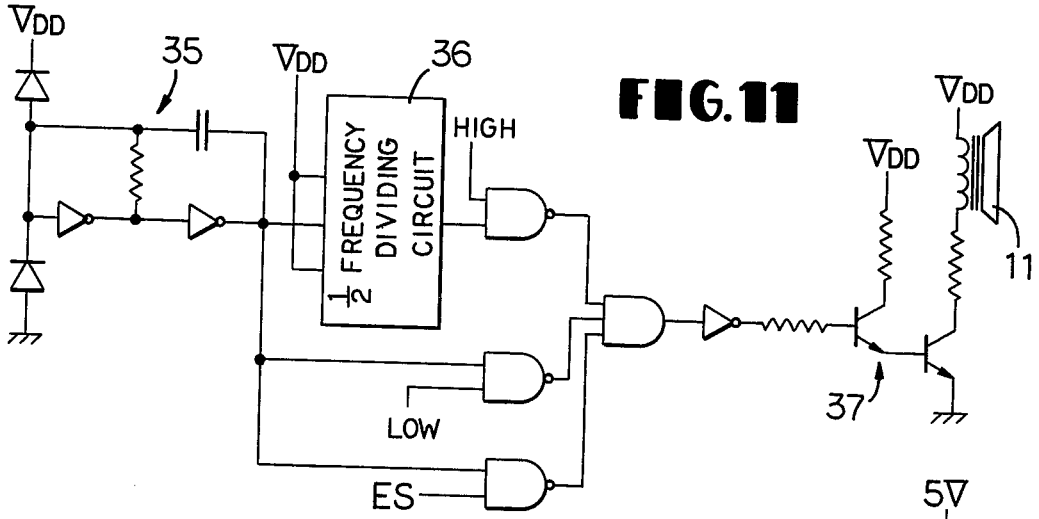
FIG. 11 is a circuit for driving speaker 11.

In FIG. 11 are included an oscillation circuit 35, a frequency dividing circuit 36, and a speaker driving circuit 37 for driving a speaker 11 shown in FIG. 2.

When the signal HIGH generated in the circuit of FIG. 10 becomes "H" the speaker 11 produces a sound with a frequency (number) one half that of the oscillation circuit 35. When the signal LOW is "H" and the later described signal ES is "H", the speaker produces a sound with a frequency the same as the oscillation frequency.

Figure 12:
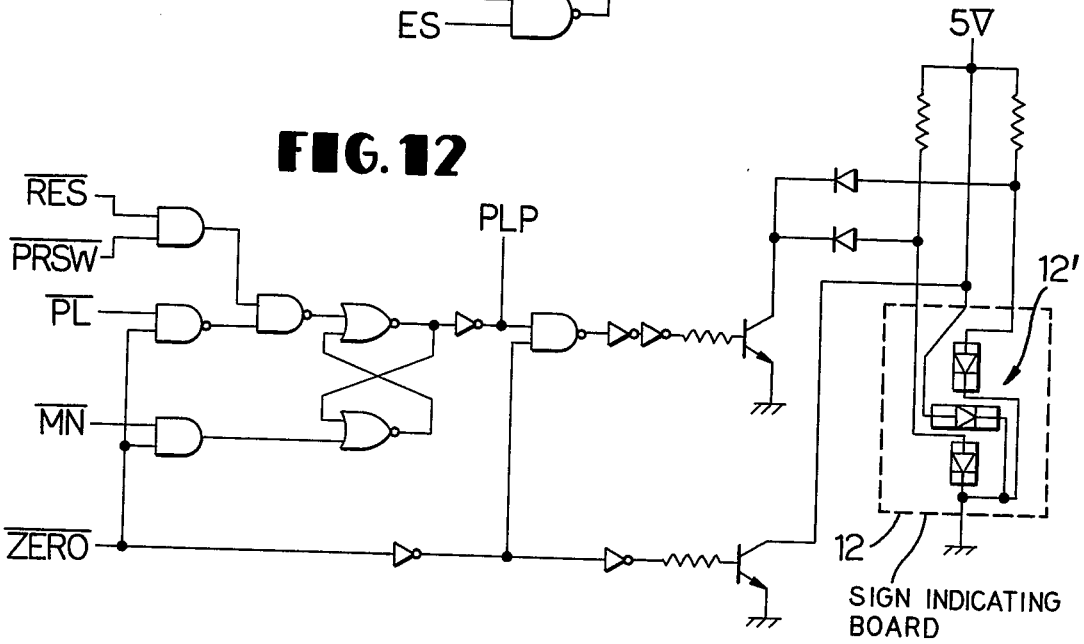
FIG. 12 is a circuit for operating a sign indicating board 12.
Figure 14:
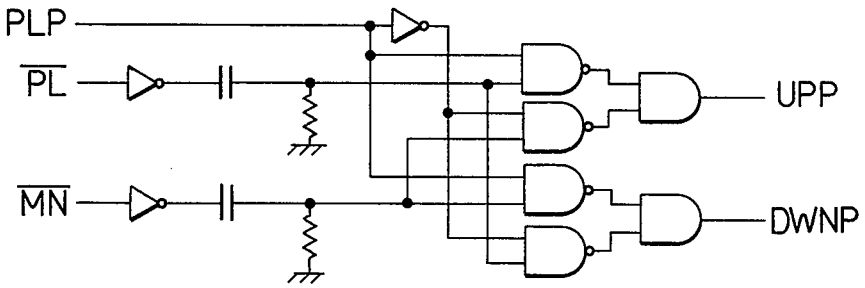
FIG. 14 is a circuit for generating signals UPP, DWNP from signals PLP, $\overline{PL}$ and $\overline{MN}$ in the control circuit 6.

A circuit indicated in FIG. 12 is for making a sign indicating board 12 in FIG. 2 luminescent. An indicator 12' is composed of three segments, i.e., two longitudinal segments and one lateral segment. When all segments are luminescent the indication is plus, when the two longitudinal segments are inactive the indication is minus, and when all segments are inactive the indication becomes zero. The change of the sign is determined by whether, when $\overline{ZERO}$="H" is maintained (in respect of $\overline{ZERO}$ explanation will be made later), $\overline{PL}$ becomes "H" or $\overline{MN}$ becomes "H". When a status of $\overline{PL}$="H" is present the signal PLP becomes "H" and a status of $\overline{MN}$="H" is present the signal PLP becomes "L". FIG. 14 indicates a circuit which produces signals UPP, DWNP from the signals PLP, $\overline{PL}$, and $\overline{MN}$. It is therefore a circuit wherein when the sign is positive the pulse signal is input to an UP terminal of counter 43 in case of addition, and to a DOWN terminal in case of subtraction; when the sign is negative the pulse signal is input to a DOWN terminal in case of addition, and to an UP terminal in case of subtraction.

Figure 13:
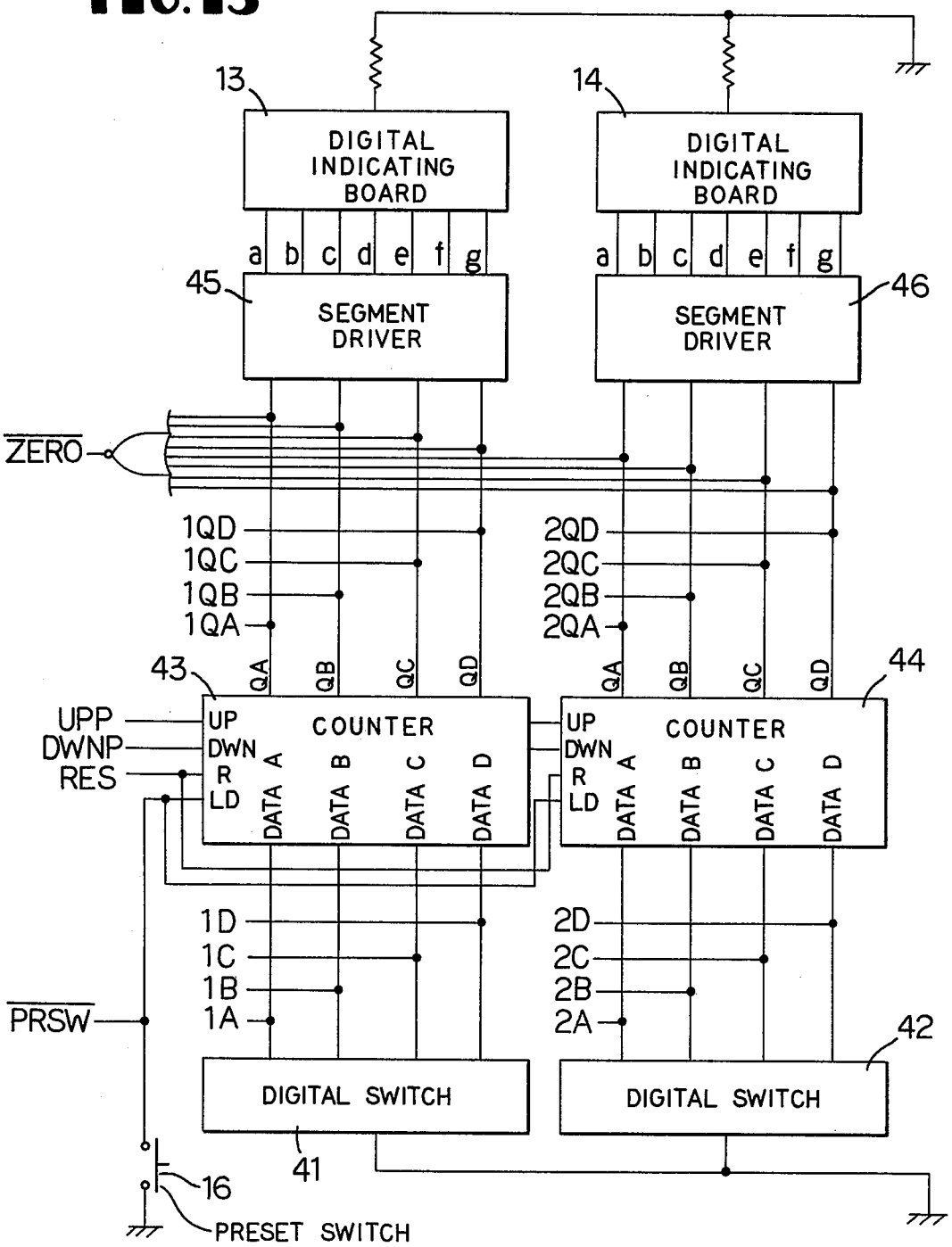
FIG. 13 is a circuit for an UP-DOWN counter 7 and numeral indicating board 13 and 14.

A circuit indicated in FIG. 13 is for an up-down counter 7, digital indicating boards 13, 14, a setting device 15, and a preset switch 16 illustrated in FIG. 2. Counters 43, 44 employed here as the up-down counter 7 are of presettable up-down type. When the preset switch 16 is turned ON the content of digital switches 41, 42 can in the setting device 15 be loaded on the counters 43, 44. When BCD outputs of the counters 43, 44 are all equal to zero, the signal $\overline{ZERO}$ becomes "H". The content of the counters 43, 44 is respectively indicated on the digital indicating board 13, 14 by means of segment drivers 45, 46.

Figure 15:
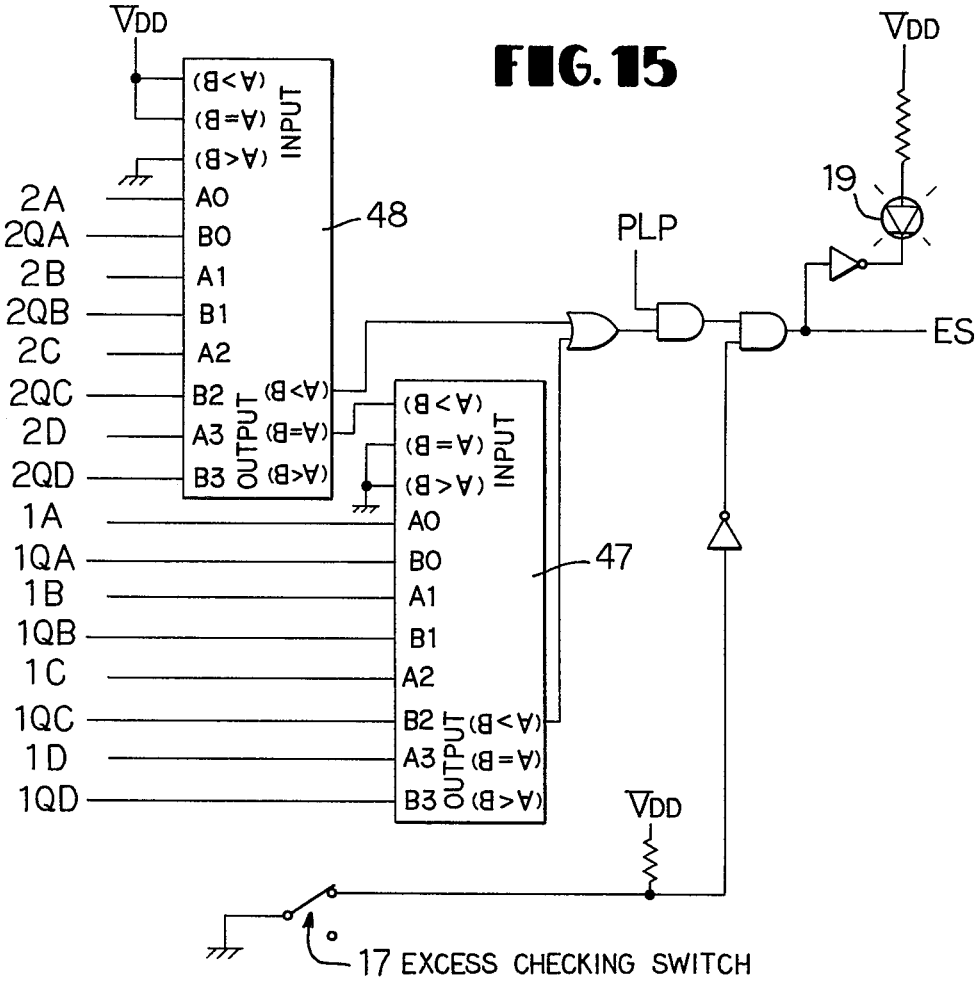
FIG. 15 is a circuit for lightening an excess indicating lamp 19.

A circuit indicated in FIG. 15 is for making an excess indicating LED 19 luminescent by means of turning ON an excess cheking switch 17 illustrated in FIG. 2. By means of comparing BCD dial setting code of two figures (output of the digital switches 41, 42—1A, 1B, 1C, 1D, 2A, 2B, 2C, and 2D) with the counter content (output of the counters 43, 44—1QA, 1QB, 1QC, 1QD, 2QA, 2QB, 2QC, and 2QD) by employing two comparators 47, 48, the excess indicating LED 19 is made luminescent and the signal ES is made "H" when the latter is larger than the former in comparison.

The apparatus having the above-mentioned structure will perform the counting operation when the following conditions are satisfied.

(1) All of the four photo-switches (1A-2A*a*), (1A-2A*b*), (1B-2B*a*), and (1B-2B*b*) of the trunk portion sensing section are once interrupted simultaneously. Owing to the structure explained with respect of FIG. 5, all of the four photo-switches of the trunk portion sensing section must be simultaneously interrupted for some duration of time, even though for an instant, and a human body can be detected as it suffices this requirement. A thin or slender thing such as a ski can not suffice this requirement of interrupting the four of the photo-switches at a time, although it interrupts the leg portion sensing section. So it can not be counted as one.

(2) The photo-switches of the leg portion sensing section (1C-2C*a*) and (1C-2C*b*) must be interrupted while one or more of the photo-switches of the trunk portion sensing section (1A-2A*a*), (1A-2A*b*), (1B-2B*a*), and (1B-2B*b*) are being in interruption.

Due to the structure explained in respect of FIG. 4, the passing of leg portion is memorized when the photo-switches of the leg portion sensing section are interrupted during a human body is interrupting at least one of the photo-switches of the trunk portion sensing section, and the counting takes place when the trunk portion has finished passing all of the said four of the photo-switches. Therefore, a mere interruption of the photo-switches of the trunk portion sensing section by swinging the arms or a mere passage of a baggage will not be counted as one.

(3) The order of interrupting the photo-switches of the leg portion sensing section and that of interrupting the photo-switches of the trunk portion sensing section must agree. For example, when the photo-switches of the leg portion sensing section have detected in the plus direction, the photo-switches on the going-out side of the trunk portion sensing section must also be detected in the plus direction. Due to the structure explained in respect of FIGS. 5 to 7, only when the directionality of the signal R or L which is obtained in accordance with the direction of the detection at the trunk portion sensing section and the directionality of the detection at the leg portion sensing section are agreeable, the signal PL or MN can be obtained, which enables the counting to be carried out.

(4) The photo-switches of the trunk portion sensing section are restored to the original state, that is, a state that have not sensed an interruption by the trunk portion, with a state wherein the photo-switches of the leg portion sensing section once detected an interruption in the plus direction or minus direction and did not afterwards detect an interruption in the reverse minus or plus direction. When a man, once passed the photo-switches of the leg portion sensing section, turned back without passing through the trunk portion sensing section, the memory of the leg portion sensing signal is erased lest the counting operation should be performed, owing to the structure explained in respect of FIGS. 6 and 7.

According to this embodiment, as described above in greater detail, a person who comes inside from outside is counted up as plus 1, when he passes the trunk portion sensing section in the order of (1B-2B*a*)→(1B-2B*b*) and the leg portion sensing section in the order of (1C-2C*a*)→(1C-2C*b*)—in case wherein the passing direction converting switch 8 is connected to the coming-in side—and a person who goes out from inside to outside is counted up as minus 1, when he passes the photo-switches of the trunk portion sensing section and the leg portion sensing section in the reverse direction. And the indicating board shows the number of persons staying inside. With this apparatus the number of passengers of a vehicle and visitors to a building or some other institutions can be easily and exactly counted.

As for a vehicle or some other facilities which have a certain capacity, this apparatus enables excess or margin to be automatically indicated by means of setting in advance, with a setting device 15, the number of full capacity. In case of being installed, for example, in an autobus, if it is set at 50 persons as the full capacity, it shows −40 when the number of passengers is 10, 0 when passengers reached 50, and +10 when passengers on board are 60. This setting device is possible to be converted (changed over) in its directionality.

Furthermore, the apparatus has the benefit of warning the watchman, each time of passing a person, due to the speaker 11 emanating different sounds and/or the indicating lamps different in color according to coming-in and going-out.

Some other useful applications of this apparatus will be described by way of examples.

(1) When the apparatus are installed in plural number for one object, a centrlized controlling system may be taken at a desired place by means of confirming the value shown in each apparatus.

(2) Additional use of a printer makes it possible to print out the number and variation of the persons coming-in and going-out. By attaching a watch to this apparatus, it becomes possible to investigate statistically the number and variation of the persons according to the time zone.

(3) A parallel use with a metal detecting device is also permissible at a necessary place, for example, an airport, without requiring any special space, which will contribute to the economy of space.

Figure 17:
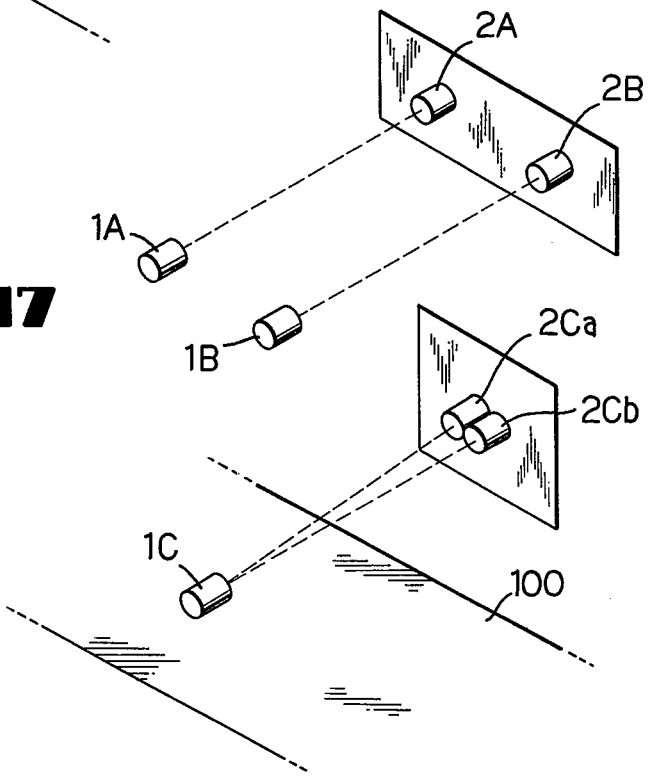
FIG. 17 is a perspective view showing the arrangement of photo electric switches in a passing person counting apparatus of another embodiment of this invention.

Additionally commenting, a directional detection of a passing person is attempted in this embodiment by installing two sets of sensing means even in the trunk portion sensing section, not only in the leg portion sensing section. It is, however, possible to attach a direction sensing means only to the leg portion sensing section, because human legs do not assume a movement, as arms do, reversing the passing direction. In this case, as shown in FIG. 17, only a pair of the photo-switches 2A, 2B of the trunk portion sensing section, arranged with a distance slightly smaller than the thickness of a trunk portion of a human body, will be enough. Confirmation of a person having completely passed in one direction can be made by the restoration of all photo-switches 2A, 2B of the trunk portion sensing section, which have once been interrupted simultaneously, back to the non-interrupted status, on condition that a leg which has interrupted a plurality of pairs of photo-switches 2C*a*, 2C*b* of the leg portion sensing section has not turned back without passing through them. Increasing of the number of groups of the photo-switches installed and the number of photo-switches installed in one group is also possible, which will contribute to decreasing the probability of the miscounting.

In this embodiment one light source is confronted with two photodetectors to form a group of photo-switches, which are free from being interfered with each other irrespective of their installation with a small inter-distance therebetween; moreover, the number of light sources are advantageously decreased. Of course it is possible to install one light source in confrontation with one photodetector. Another embodiment employing a supersonic wave switch as a sensor, which is operated by supersonic wave signals, is possible.

Various circuits for treating the signals from the photo-switches can be modified or altered in many ways, although not exemplified specifically. This invention should be interpreted to include all of those modifications and variations in its sphere.

What is claimed is:

1. A passing person counting apparatus installed in a passageway having a nearer side, an outlet and a width allowing one person to pass through comprising:

(a) at least first and second trunk-portion-sensor groups installed in said passageway at a height of the trunk portion of human bodies to be counted and with an inter distance slightly narrower than the thinnest one of human bodies to be counted, each of said trunk-portion-sensor groups including at least a first and a second trunk portion sensor closely arranged to each other, each of said trunk portion sensors being provided with a signal sending part for sending a signal traversing substantially horizontally said passageway and a signal receiving part for receiving said signals varying in response to whether being interrupted or not;

(b) a leg-portion-sensor group including at least first and second leg portion sensors, installed in said passageway at a height of the leg portion of human bodies to be counted and between the first and second trunk-portion-sensor groups, said leg portion sensors being closely arranged to each other in the passing direction of said passageway and in the same order as said trunk portion sensors, each of said leg portion sensors being provided with a signal sending part for sending a signal traversing substantially horizontally said passageway and a signal receiving part for receiving said signal, said signals varying in response to whether being interrupted or not;

(c) means including at least three circuits and counter means coupled to said three circuits for receiving confirming signals from said three circuits to confirm that the confirming signals have been received from all three said circuits and to indicate result of counting, said three circuits including:

(i) a first circuit coupled to said trunk portion sensors for producing a width confirming signal upon having confirmed the fact that all the signals of the trunk portion sensors have been at least for an instant simultaneously interrupted;

(ii) a second circuit coupled to said trunk portion sensors and to at least one of said leg portion sensors for producing a simultaneousness confirming signal upon having confirmed the fact that at least one signal from the trunk portion sensors was interrupted while at least one of the signals from the leg portion sensors was being interrupted; and (iii) a third circuit coupled to at least two of said leg portion sensors and at least two of said trunk portion sensors which are installed on the nearer side to the outlet of said passageway for producing a passing-through confirming signal upon having confirmed a body, which had interrupted the signals of the leg portion sensors and the trunk portion sensors, passed through said passageway.

2. A passing person counting apparatus claimed in claim 1, wherein said third circuit is one which produces a passing-through confirming signal upon having confirmed two facts (1) that a signal of a first leg portion sensor of said portions sensors was being interrupted at a moment of interruption of a second leg portion sensors of said leg portion sensors and (2) that a signal of a first trunk portion of said said second trunk-portion sensor group was not being interrupted at the moment of transition wherein the signal of a second trunk portion sensor of the second trunk-portion-sensor group changed from an interrupted status to a non-interrupted status.

3. A passing person counting apparatus claimed in claim 1, wherein said third circuit is one which produces a passing-through confirming signal upon having confirmed the fact that first and second leg portion sensors were not restored from a signal-interrupted status to a non-signal-interrupted status in reverse order of the interruption, and that all of said trunk portion sensors which ad been once simultaneously interrupted of signal have been restored from a signal-interrupted status to a non-signal-interrupted states.

4. A passing person counting apparatus claimed in claim 1, wherein said counter means is provided with a counting circuit capable of counting in either of positive and negative direction in accordance with the passing direction of persons, and said counting means is constructed such that said third circuit effectuates its counting circuit which counts the number of passers in a direction which advances from the earlier interrupted to the other out of a first leg portion sensor and a second leg portion sensor of said leg portion sensors and ineffectuates its counting circuit which counts the number of passes in the opposite direction.

5. A passing person counting apparatus claimed in claim 1, wherein each of said signal sending parts of the trunk portion sensors and the leg portion sensors is respectively a light source, and each of said signal receiving parts thereof is respectively a photo-electric converter producing electric signals of different levels in accordance with whether it receives light or not.

6. A passing person counting apparatus claimed in claim 1, wherein each of said trunk-portion-sensor groups and said leg-portion-sensor groups is respectively composed of one signal sending part and a plurality of signal receiving parts corresponding thereto.

7. A passing person counting apparatus claimed in claim 1, wherein said counting means is provided with a counting circuit capable of counting the number of persons passed in either a forward or reverse direction in accordance with the passing direction of persons, and further including a passing direction noticing means for noticing the direction of passing of a person counted in accordance to whether it was forward or reverse.

8. A passing person counting apparatus installed in a passageway having a near side, an outlet and a width allowing one person to pass through comprising:

(a) first and second trunk portion sensors installed in said passageway at a height of the trunk portion of human bodies to be counted and with an inter-distance slightly narrower than the thinnest one of human bodies to be counted, said trunk portion sensors being provided with a signal sending part for producing a signal traversing substantially horizontally said passageway and a signal receiving part for receiving said signal, said signals varying in response to whether being interrupted or not;

(b) at least a first and a second leg portion sensors installed in said passageway at a height of the leg portion of human bodies to be counted and between the first and the second trunk portion sensors, closely arranged to each other in the passing direction of said passageway and in the same order as said trunk portion sensors, each of said leg portion sensors being provided with a signal sending a signal traversing substantially horizontally said passageway and a signal receiving part for receiving said signal said signals varying in response to whether being interrupted or not;

(c) means including at least three circuits and counter means coupled to said three circuits for receiving confirming signals from said three circuits to confirm that the confirming signals have been received from all three said circuits and to indicate result of counting, said three circuits including:

(i) a first circuit coupled to said trunk portion sensors for producing a width confirming signal upon having confirmed the fact that all the signals of said first and second trunk portion sensors have been at least for an instant simultaneously interrupted;

(ii) a second circuit coupled to said trunk portion sensors and at least one of said leg portion sensors for producing a simultaneousness confirming signal upon have confirmed the fact that at least one of the signals of the trunk portion sensors was interrupted while at least one of the signals of the leg portion sensors was being interrupted; and (iii) a third circuit coupled to at least two of said leg portion sensors and at least two of said trunk portion sensors which are installed on said nearer side of said outlet of said passageway for producing a passing-through confirming signal upon having confirmed the fact that a body, which had interrupted the signals of the trunk portion sensors and the leg portion sensors, passed through said passageway.

9. A passing person counting apparatus claimed in claim 8, wherein said third circuit produces a passing-through confirming signal upon having confirmed the fact that the signal from said first and second leg portion sensors have not been restored to the non-interrupted status in the reverse order to that when interrupted, and that both the first and second trunk portion sensors, which had once been simultaneously interrupted of the signal have been restored to the non-interrupted status.

10. A passing person counting apparatus claimed in claim 8, wherein said counter means is provided with a counting circuit capable of counting in either positive and negative direction in accordance with the passing direction of persons, and said counter means is constructed such that said third circuit effectuates the counting circuit which counts passings in one direction which advances from a firstly interrupted to the other of said first leg portion sensor and said second leg portion sensor and ineffectuates the counting circuit which counts passings in the opposite direction.

* * * * *